United States Patent [19]

Elliott

[11] 4,204,780

[45] May 27, 1980

[54] TYPEWRITER WITH IMPROVED CASE SHIFT MEANS

[75] Inventor: Anthony Elliott, Nottingham, England

[73] Assignee: Dobson Park Industries, Limited, Nottingham, England

[21] Appl. No.: 833,446

[22] Filed: Sep. 15, 1977

[30] Foreign Application Priority Data

Sep. 21, 1976 [GB] United Kingdom ..... 39140/76

[51] Int. Cl.[2] ..... B41J 11/16

[52] U.S. Cl. ..... 400/261; 400/216.6; 400/434.2; 400/685; 400/693

[58] Field of Search ..... 400/261, 216.6, 266.2, 400/491.2, 434.2, 685, 693

[56] References Cited

U.S. PATENT DOCUMENTS

| | | | |
|---|---|---|---|
| 532,153 | 1/1895 | Graham et al. | 400/491.2 |
| 1,013,084 | 12/1911 | Westin | 400/261 |
| 1,098,542 | 6/1914 | Wisner | 400/261 |
| 1,203,683 | 11/1916 | Anderson | 400/261 |
| 1,412,637 | 4/1922 | Uhlig | 400/261 |
| 2,692,037 | 10/1954 | Reichert et al. | 400/491.2 |
| 2,692,038 | 10/1954 | Winter | 400/491.2 |
| 2,705,553 | 4/1955 | Thomson | 400/261 X |
| 3,057,449 | 10/1962 | Thomson | 400/261 X |

*Primary Examiner*—Ernest T. Wright, Jr.
*Attorney, Agent, or Firm*—Bertram Frank

[57] ABSTRACT

In a typewriter of the kind having a carriage movable vertically relative to the type bar assembly to provide three cases of type, the carriage rests on a shift member slidable vertically in guides formed in the body of the typewriter and a spring acts between the body and the shift member biassing the shift member to an intermediate position. One shift key moves the shift member to a lowermost position, overcoming the spring bias, and a second shift key moves the shift member to an uppermost position, overcoming the weight of the carriage.

6 Claims, 11 Drawing Figures

112
114
100
102
104
106
108
110
120
122
128
130'
140'
140
139
138'
138
190
198
195
256
230
228
232
222
218
216
220
176
178
172
170
174
162
160
164
168
166
180
4
124
132
128
130
126
134
144
148
150
151

TYPEWRITER WITH IMPROVED CASE SHIFT MEANS

This invention relates to typewriters. More particularly, but not exclusively, the invention relates to toy typewriters.

More particularly, the invention relates to typewriters of the kind having a typebar assembly and a carriage which is movable vertically relative to the typebar assembly to enable it to take up one of three positions to provide three cases of type. In such typewriters known hitherto the mechanisms for effecting movement of the carriage from one to another of its three positions have been relatively complex and have required precision machining of the movable parts of the mechanisms.

According to this invention there is provided a typewriter having a typebar assembly and a carriage which is movable vertically relative to the typebar assembly to enable it to take up one of three positions to provide three cases of type, in which the carriage rests on a shift member slidable vertically in guides formed in the body of the typewriter, and there is provided a spring acting between the typewriter body and the shift member and biasing the shift member to an intermediate position with a force sufficient to overcome the weight of the carriage acting on the shift member, a first shift key linked to the shift member so that actuation of the key lifts the shift member and carriage to an uppermost position, and a second shift key linked to the shift member so that actuation of the key moves the shift member and carriage downwards against the bias of the spring to a lowermost position.

Suitably, the typewriter includes a ribbon vibrator arranged on operation of a type bar to raise the length of ribbon supported by the vibrator to the appropriate position between the platen and type head and to lower the length of ribbon after it has been struck by the type head, and the vibrator is moved through the intermediary of a lever pivotally mounted on the shift member, the lever engaging the vibrator so that the vibrator moves together with the shift member on movement of the shift member from one to another of its three positions, and the lever being engaged by an element movable on actuation of each type bar thereby to operate the vibrator, the engagement between the lever and element being between two mutually contacting members formed on the lever and element respectively, at least one of the members being generally vertically elongated to ensure engagement between the element and lever to operate the vibrator in each of the three positions of the shift member.

Figure 1:
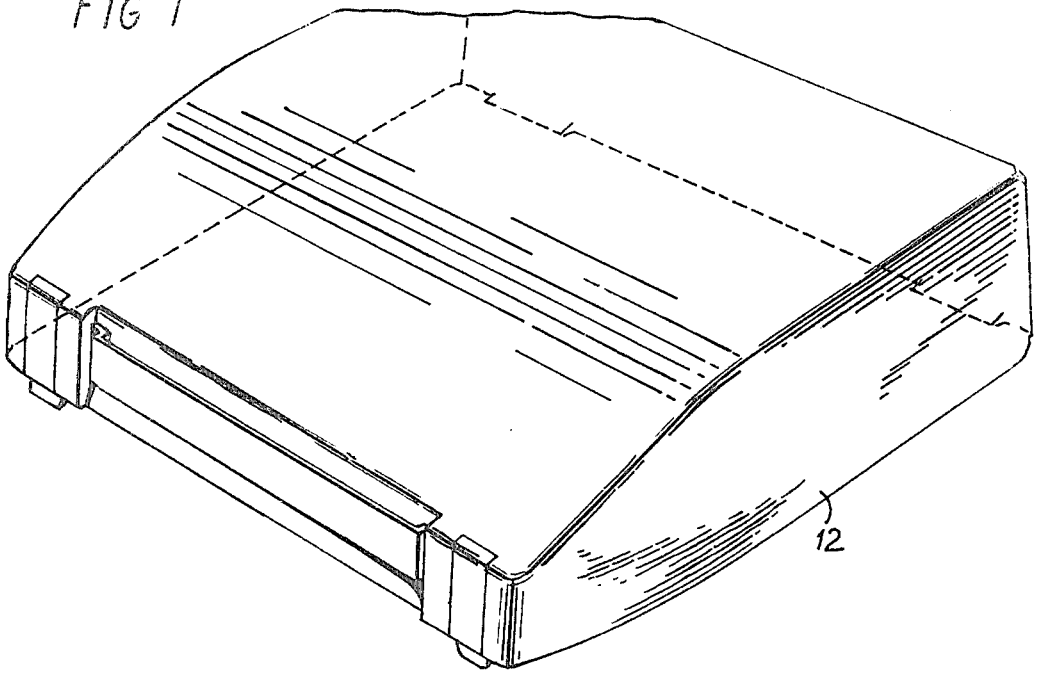
Figure 1:
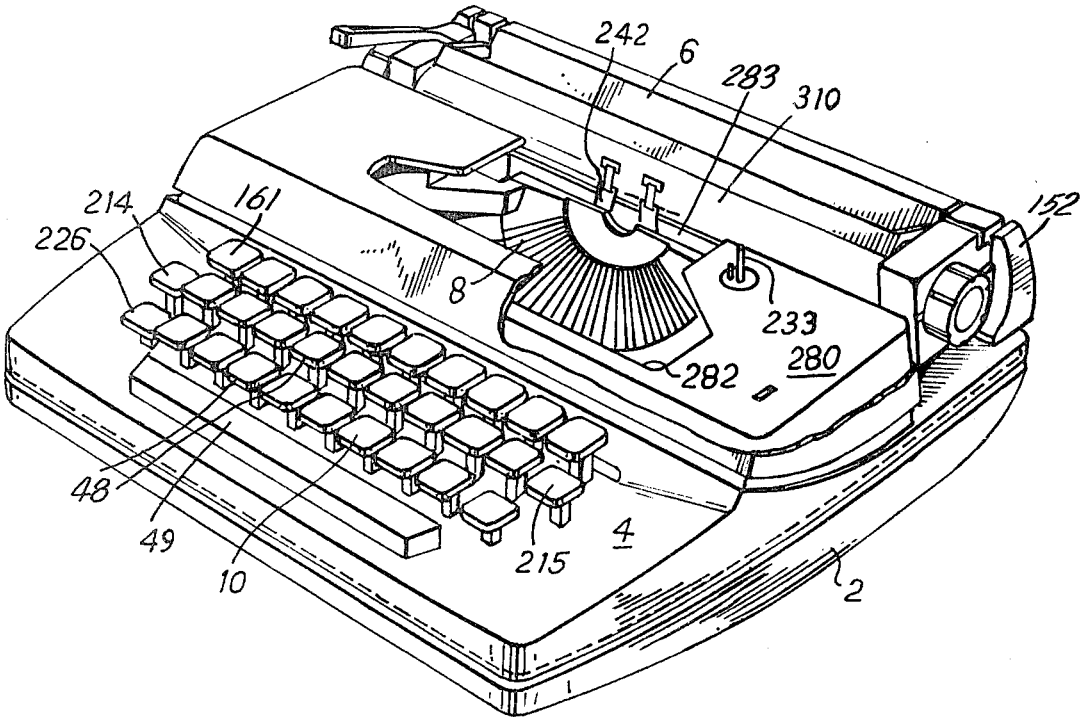
Figure 2:
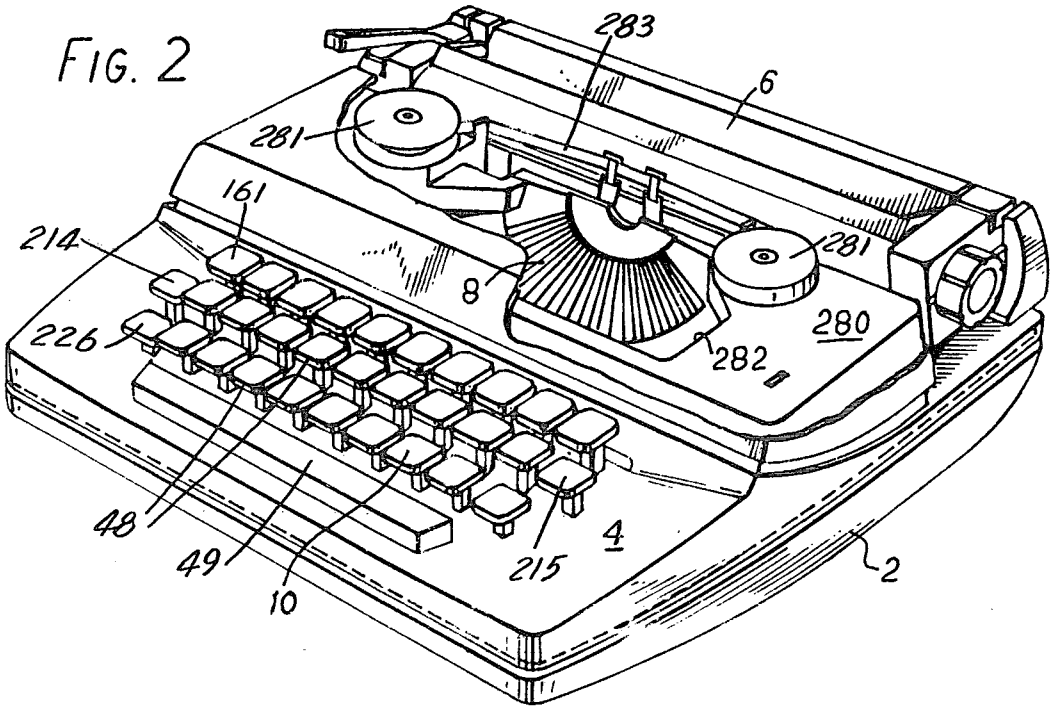
Figure 3:
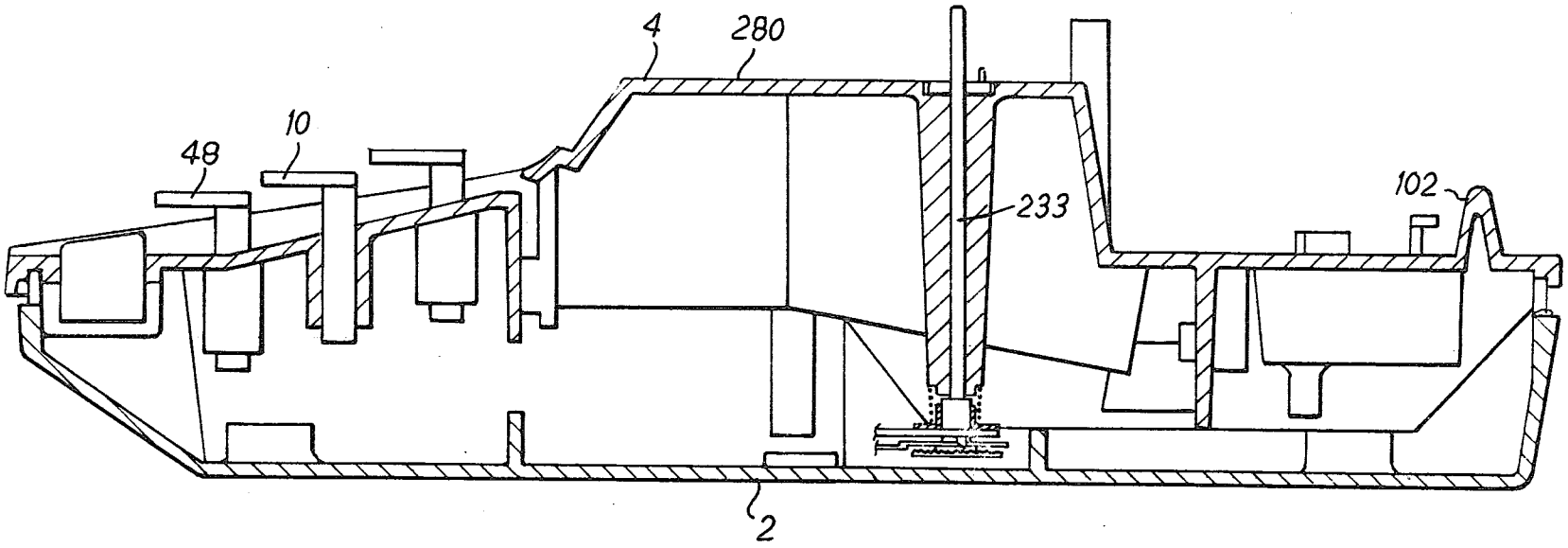
Figure 4:
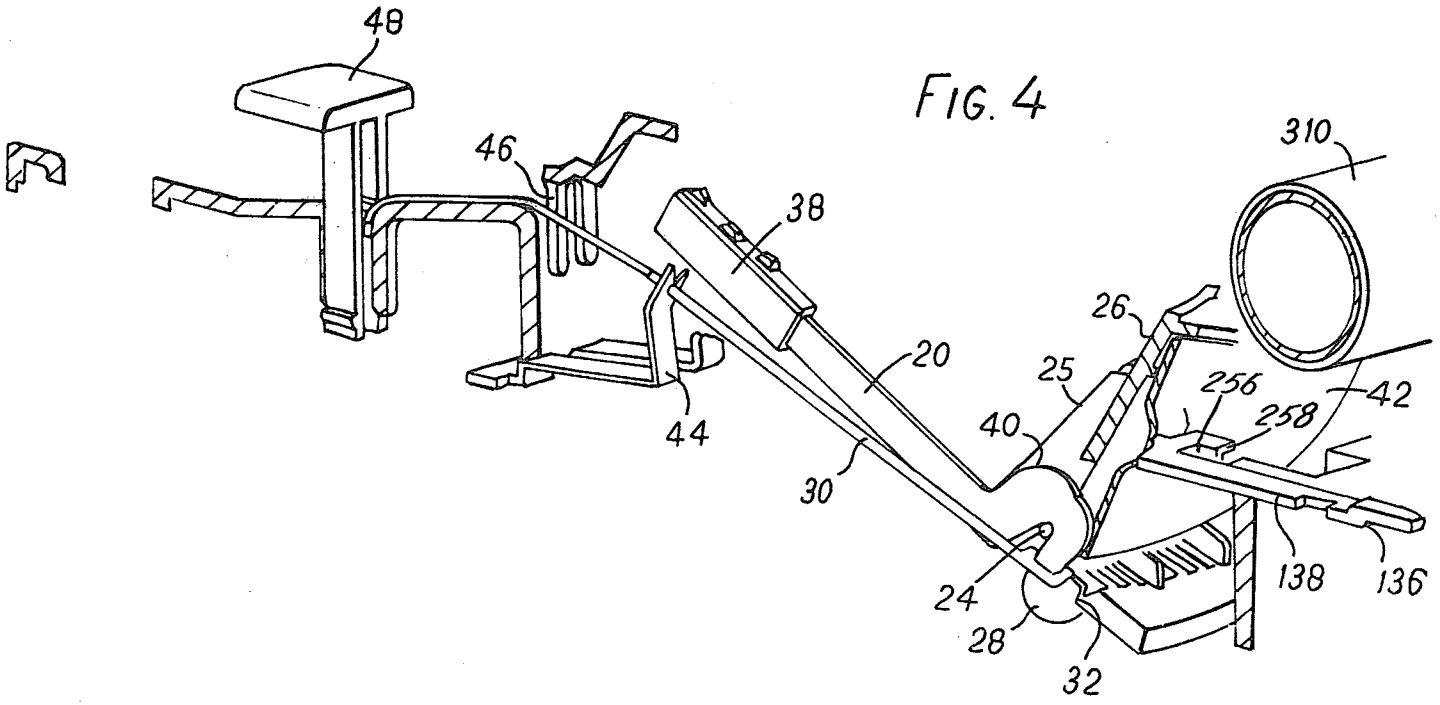
Figure 5:
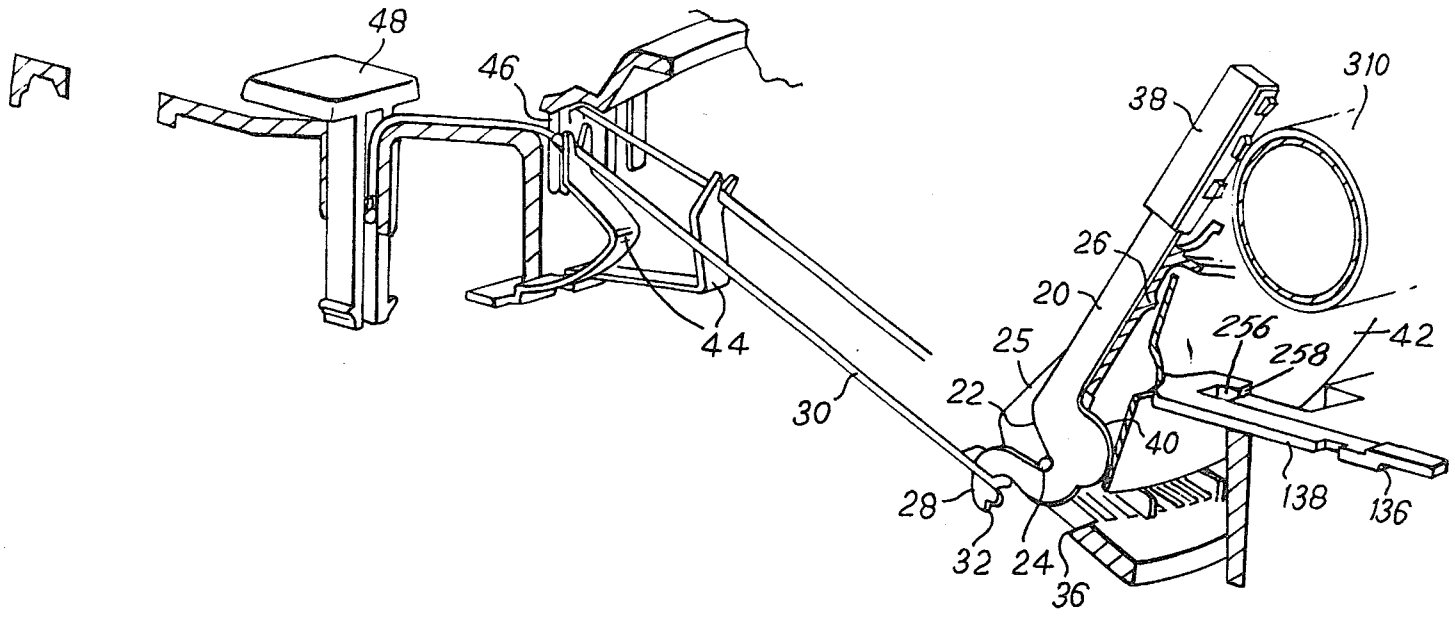
Figures 6, 7, 8:
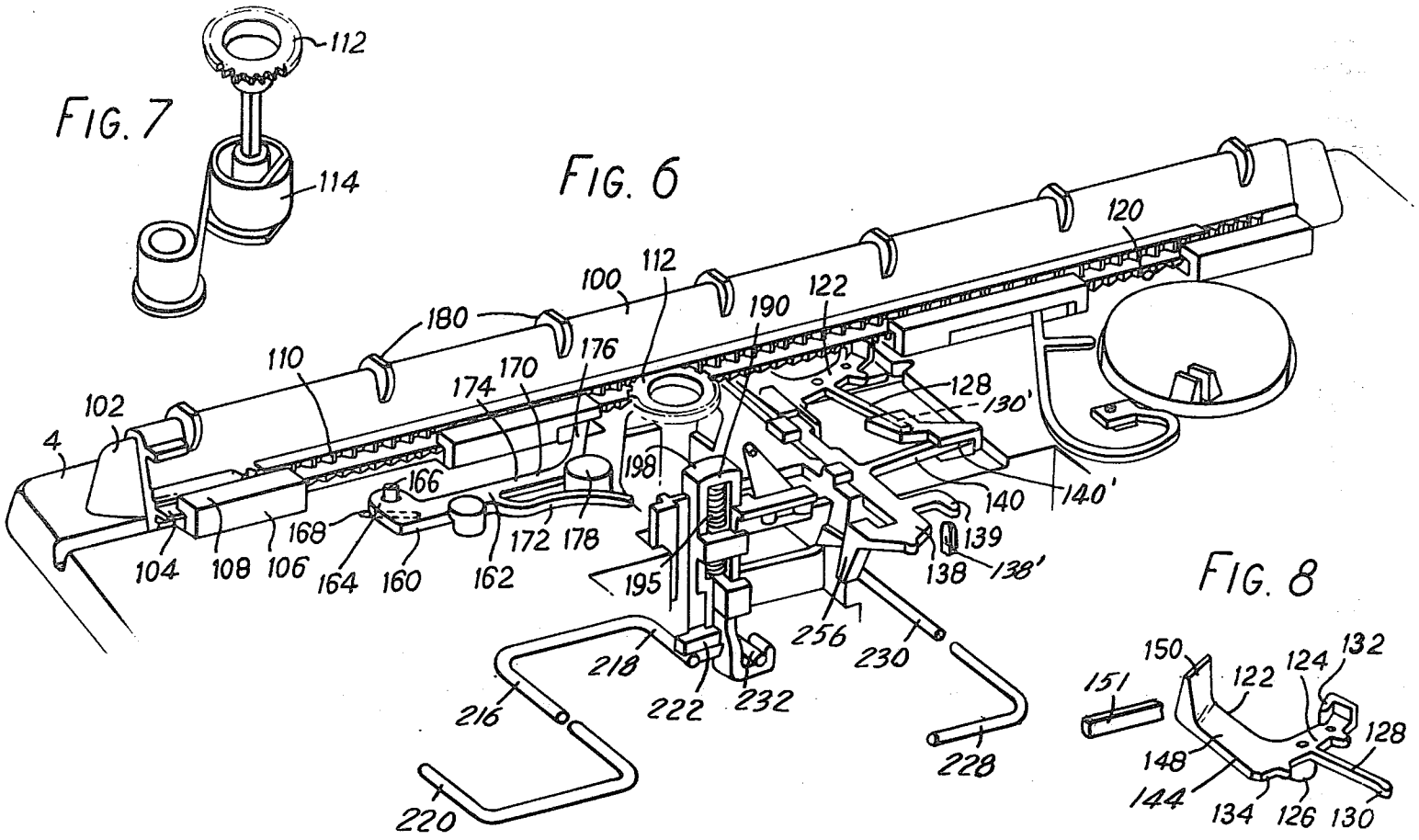
Figure 9:
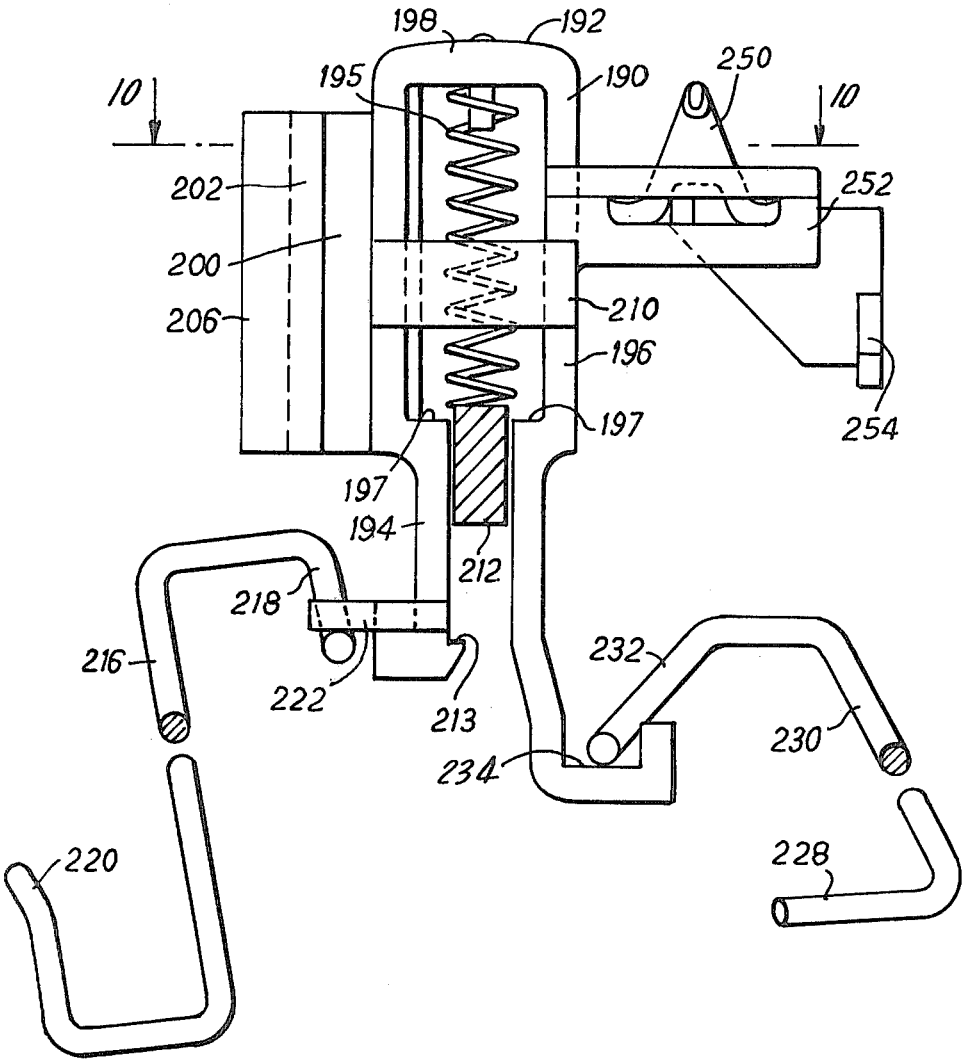
Figure 10:
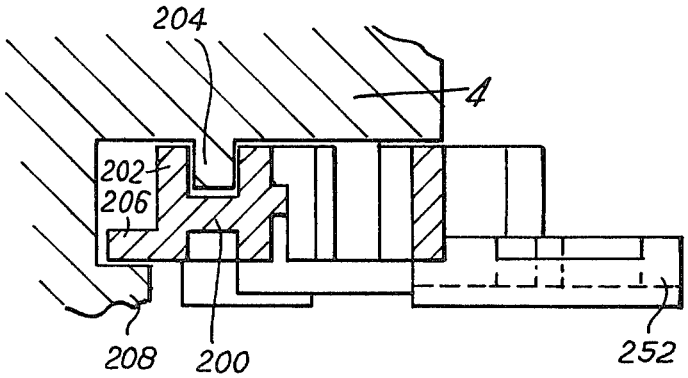
Figure 11:
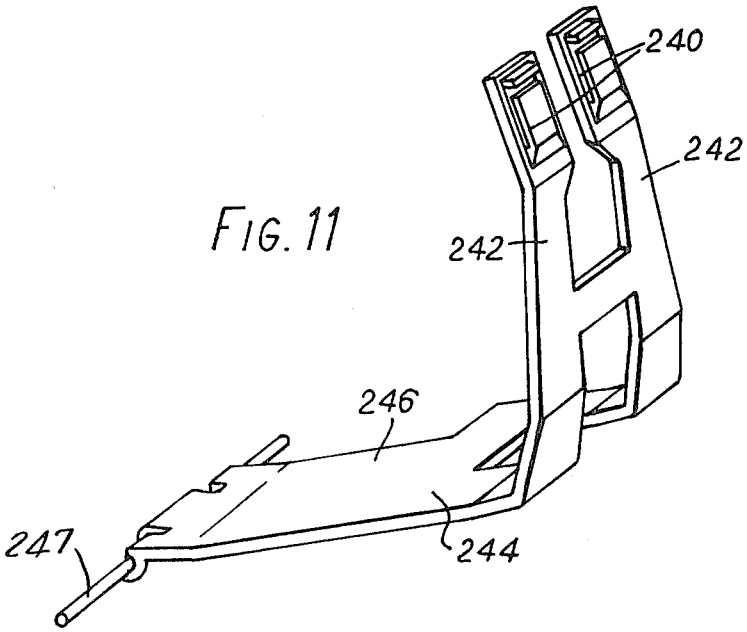

The invention will now be described, by way of example, with reference to the accompanying diagrammatic drawing, in which:

FIG. 1 is a perspective view of a typewriter and case incorporating the invention, FIG. 2 is a perspective view of the typewriter with a top cover removed and showing two ribbon spools in position on the typewriter, FIG. 3 is a section through the body of the typewriter, with the carriage and various other mechanisms omitted, FIG. 4 is a fragmentary perspective view, partly in section, showing a key, type bar and associated mechanisms of the typewriter, with the type bar in its rest position, FIG. 5 is a view similar to that of FIG. 4, but showing the type bar in position as the type head strikes the platen, FIG. 6 is a fragmentary perspective view of the carriage slide and associated mechanisms of the typewriter, FIG. 7 is a perspective view of a drive pinion and driving spring of the typewriter, FIG. 8 is a perspective view of the escapement dog of the typewriter, FIG. 9 is a front elevation of a shift member and associated components of the typewriter, FIG. 10 is a section on line 10—10 of FIG. 9 with the vibrator lever omitted, and FIG. 11 is a perspective view of the vibrator of the typewriter.

Referring to the drawing, the typewriter includes a base 2 and a body 4, which support a carriage 6 movable on the body 4, a type bar assembly 8 and a keyboard 10. A case 12 fits removably over the body 4.

The type bar assembly 8 comprises a series of type bars 20 pivotally mounted on a fulcrum 24 formed on a segment 26. Each type bar 20 is shaped at one end to provide a V-shaped recess 22 which can receive the fulcrum 24, which is in the form of a bead moulded integrally with the segment 26, so that the type bar 20 pivots about the fulcrum 24, the type bar 20 moving in and being guided by a slot 25 in the segment 26. At one side of the recess 22 the type bar 20 is shaped to form a hook portion 28 to which is attached one end of an actuating string 30, as described below. The end of the hook portion 28 is formed with a notch 32 which, in the reset position of the type bar 20, engages a stop formed by an edge 36 of the segment 26. The edge 40 of type bar 20 opposite recess 22 forms a cam surface which engages a bail 42 in the form of a flat steel plate. Operation of any of the type bars 20 causes the bail 42 to pivot, as described in published British patent specification 859,835, and to displace an escapement release lever 138 which effects operation of the carriage escapement and other mechanisms, as described below. A type head 38 is moulded onto the other end of each type bar 20, as described in published British patent specification 934,402. Each type head 38 is formed with three characters, corresponding to the three shift positions of the carriage 6, as described below.

The actuating string 30 for each type bar 20 passes through a return spring 44, and a guide slot 46 in the typewriter body 4, to the associated key 48, so that depression of the key 48 causes the type bar 20 to move from the rest position shown in FIG. 4 to the position shown in FIG. 5, whilst on release of the key 48 the type bar 20, key 48 and string 30 move to their rest positions under the weight of the type bar 20 and the action of spring 44. The manner of the connection of the strings 30 to the type bars 20 and keys 48 is the subject of a co-pending application of Robert Denby Ser. No. 833,592, filed Sept. 15, 1977.

The carriage 6 is mounted on a carriage slide 100 which is shaped to fit over and slide along an elongate support 102 formed integrally with the body 4. The slide 100 is retained on the body 4 by means of a horizontal locating flange 104 extending the length of the slide 100 and engaging beneath flanges 108 on retaining members 106 formed integrally with the body 4. Extending along the slide 100 is a rack 110, which is engaged by a drive pinion 112. The pinion 112 is rotatable in the body 4 and is biassed by a constant tension spring 114 to rotate in a sense to drive the carriage slide 100 from right to left as seen in FIG. 1.

Beneath the locating flange 104, the slide 100 is formed with a series of escapement teeth 120 which are engaged by an escapement dog 122. The escapement dog 122 is moulded in one piece from plastics material, and has a body portion 124 from the lower face of which projects a boss 126 by means of which the dog 122 is located in the body 4 of the typewriter in such a manner that the dog 122 can pivot about a vertical axis through the boss 126 and also move through a small distance parallel to the direction of movement of slide 100. A narrow spring portion 128 extends from the body portion 124 and ends in a bead 130 located in a recess 130' in the body 4. The spring portion 128 biases the body portion 124 of the dog 122 to a position in which a tooth 132 at one end of the body portion 124 engages between adjacent escapement teeth 120 on the slide 100 to hold the slide 100 against movement by the drive pinion 112.

To effect release of the escapement on each operation of a type bar 20, an abutment face 134 at one end of the body portion 124 of the escapement dog 122 is engaged by an abutment 136 formed at one end of the escapement release lever 138, the other end of which engages the bail 42. The escapement release lever 138 moves linearly in the body 4 of the typewriter and is biased into engagement with the bail 42 by a spring portion 140 formed integrally with the escapement release lever 138 and engaging at its free end in a recess 140' in the body 4. Movement of the bail 42 on operation of a type bar 20 causes the escapement release lever 138 to move the escapement dog 122 so that it pivots to withdraw the tooth 132 from the escapement teeth 120, thereby to allow movement of the slide 100 by the spring 114. At the same time the escapement dog 122 is moved sideways so that the abutment 136 on the escapement release lever 138 slips from the abutment face 134 of the escapement dog 122, the abutment 136 then moving alongside the adjacent face 144 of the dog 122. The dog 122 therefore moves back under the influence of its spring portion 128 so that the tooth 132 engages between the next pair of escapement teeth 120. The escapement release lever 138 is moved back to its rest position by its spring portion 140 when key 48 is released. The escapement release lever 138 can also be moved by depression of the space key 49, the space key 49 being connected by a wire to the lower end of an intermediate lever 138' pivoted in the typewriter body 4. The upper end of the intermediate lever 138' engages a projection 139 formed on the escapement release lever 138, so that the release lever 138 is displaced when the intermediate lever 138' is pivoted on depression of the space key 49.

The escapement dog 122 is also formed with a lever portion 148 which extends from the body portion 124 so as to pass freely beneath the carriage slide 100 and terminates in an upstanding lug 150. Lug 150 is engaged by a bar 151 pivotally mounted in the carriage 6 and movable by means of a knob 152 on the carriage 6 to enable the escapement dog 122 to be pivoted to release the escapement.

The escapement teeth 120 are formed in saw-tooth fashion, so that the carriage 6 can be moved manually from left to right as seen in FIG. 1 without releasing the escapement, the escapement dog 122 being pivoted by engagement with each tooth 120 in the manner of a ratchet.

The escapement teeth 120 can also be engaged by a back-space dog 160 on depression of a back-space key 161 to move the carriage 6 one space to the right, as seen in FIG. 1. The back-space dog 160, moulded in one piece from plastics material, has a body portion 162 at one end of which is a laterally extending lug 164. The lug 164 receives the end of a rod 166 projecting upwardly through a slot 168 in the typewriter body 4. The rod 166 is linked to the back-space key 161 so that on depression of the back-space key 161 the end of the rod 166 moves along the slot 168 and moves with it the back-space dog 160.

Extending from the other end of the body portion 162 of the dog 160 are two arms 170 and 172 which are thin enough to be resiliently flexible. The arm 170 has a straight portion 174 which extends, in the rest position of the dog 160, parallel to the carriage slide 100, and which is joined through an arcuate portion to a somewhat thicker portion 176 extending at 60° to the direction of movement of the carriage slide 100. At its free end the arm portion 176 is shaped so that it can engage between two adjacent escapement teeth 120 when the dog 160 is moved to the right to move the carriage slide 100 to the right. The other arm 172 is arcuate in shape and curves away from arm 170 towards its free end. The two arms 170 and 172 engage an upstanding cylindrical boss 178 formed on the typewriter body 4. The boss 178 is disposed between the two arms 170 and 172 so that it is adjacent the junction of the straight and curved portions 174 and 176 of arm 170 when the back-space dog 160 is in its rest position.

In operation, when the back-space key 161 is depressed to move the rod 166 to the right, the back-space dog 160 is pushed to the right. The arm 170 is initially flexed by engagement of its curved portion 176 with the boss 178 so that its free end is moved sideways into engagement with the escapement teeth 120 on the carriage slide 100. Continued movement of the dog 160 causes the carriage slide 100 and the carriage 6 to be moved from left to right to effect a back-spacing operation. During this movement, the other arm 172 is flexed by engagement with boss 178. The face of the arm 172 engaging the boss 178, at its point of contact with the boss 178, is inclined to the direction of movement of the dog 160, so that the resilient force with which the flexed arm 172 bears against the boss 178 has a component in the direction of movement of the dog 160 tending to return the dog 160 to its rest position. Thus, when the backspace key 161 is released, the dog 160 and the backspace key 161 are returned to their rest positions by the spring action of arm 172. During the return movement the flexibility of arm 170 allows it to ride over the escapement tooth 120 it engages, the carriage slide 100 being held in its new position by the ratchet action of the escapement dog 122.

The carriage 6 is supported on spaced part-circular locating webs 180 on the carriage slide 100, so that the carriage 6 can pivot about a horizontal axis parallel to the direction of movement of the slide 100.

The front of the carriage 6 slidably rests on an upper face 192 of a shift member 190, for example through a rib (not shown) formed on the carriage 6 and extending the length of the carriage 6. The shift member 190 is moulded in one piece from plastics material and comprises two generally parallel arms 194 and 196 joined at their upper ends by a bridging piece 198 on which is formed the upper face 192. On the arm 194 is formed a vertical, outwardly extending web 200 ending in a flange 202. The flange 202 and the adjacent part of the arm 194 form a recess in which is engaged a vertically extending guide 204 formed on the typewriter body 4. A further web 206 extending from one vertical edge of flange 202 slides against a vertical guide 208 formed on the body 4. The shift member 190 is thus guided to slide vertically up and down. The lower limit of movement of the shift member 190 is defined by the engagement of a bridge piece 210, extending between the two arms 194 and 196, with the upper face of a stop 212 formed on the typewriter body 4 and projecting between the two arms 194 and 196. The upper limit of movement is defined by engagement of a shoulder 213, formed at the lower end of arm 194, with the lower face of stop 212. A helical compression spring 195 is positioned between the upper parts of the two arms 194 and 196 and acts between the upper bridge piece 198 and the stop 212 formed on the typewriter body 4, to bias the shift member 190 upwards to an intermediate position in which shoulders 197 of the shift member 190 are level with the upper face of stop 212 and engage the lower end of the spring 195 to prevent further upward movement of the shift member 190 by the spring 195. In the intermediate position the carriage 6 is so positioned that operation of each type bar 20 causes the type head 38 to strike the platen 310 with the central one of its three characters. When the shift member 190 is moved to its uppermost position (the spring 195 being moved with the shift member 190 by the shoulders 197), the carriage 6 is raised to a position in which the lower character of each type head 38 strikes the platen 310. Similarly, when the shift member 190 is moved to its lowermost position, against the bias of the spring 195 the carriage 6 moves to a position in which each type head 38 strikes the platen 310 with the upper one of its three characters.

The shift member 190 is movable from its intermediate position to its uppermost position, by means of a shift key 214 on the keyboard 10. The shift key 214 is connected to the shift member 190 by means of a rod 216 rotatably mounted in the typewriter body 4. One cranked end 218 of the rod 216 engages beneath an abutment 222 on the shift member 190, so that the shift member 190 is raised when the rod 216 is rotated on depression of shift key 214 by engagement of the shift key 214 with the other cranked end 220 of the rod 216. The shift member 190 and shift key 214 are returned by the weight of the carriage 6 when the shift key 214 is released. Similarly, the shift member 190 is movable to its lowermost position by the action of a further shift key 226 which engages the cranked end 228 of a rotatably mounted rod 230, the other cranked end 232 of which engages in an upwardly facing recess 234 formed by the lower end of arm 196 of the shift member 190. On release of the shift key 226, the shift member 190 and carriage 6 are returned to their intermediate positions by the action of the spring 195.

The carriage 6 can also be raised to its uppermost position by means of a second shift key 215 at the opposite side of the keyboard 10 from key 214, the key 215 being coupled to the cranked end 220 of rod 216. The second shift key 215 may be a shift lock key as described in published British patent specification No. 1,430,596.

The shape and dimensions of the mutually engaged sliding parts of the shift member 190 and the body 4 are designed to prevent jamming of the shift member 190 due to the turning moments exerted on it during operation. Thus the vertical dimensions of the flanges 202 and 206 and the faces of the body 4 which they contact are chosen to give a suitable ratio between the length of the mutually engaging surfaces measured in the direction of sliding (i.e. vertically) and the width between the opposed faces between which the sliding parts of the shift member 190 moves measured horizontally both in the front-to-rear direction and side-to-side direction as seen in FIG. 10, so as to prevent jamming due to turning moments about axes parallel to both the latter directions.

The typewriter body 4 is formed with two flat horizontal surfaces 280 disposed on either side of a recess 282 which accommodates the movement of the type bars 20. Extending through each surface 280 is a shaft 233 to receive a ribbon spool 281. The flat horizontal surface 280 partially surrounding each ribbon spool 281 lessens the danger of ribbon 283 becoming tangled if one of the spools 281 is incorrectly rotated to cause ribbon 283 to "spill" from the spool 281, as described in my co-pending application Ser. No. 833,445 filed Sept. 15, 1977.

The lower ends of shafts 233 are connected to the drive pinion 112, which effects movement of the carriage 6 as described above, by means of a ratchet mechanism as described in published British Patent Specification No. 1,293,538, to provide a ribbon feed and ribbon reversing mechanism.

The ribber 283 extending between the spools 281 passes through guide slots 240 in the spaced arms 242 of a ribbon vibrator 244. The vibrator 244 acts during each operation of a type bar 20 to lift the portion of ribbon 283 between the spaced arms 242 to a position in which it is struck by the typehead 38 as it moves between the spaced arms 242 and subsequently to lower the ribbon 283 so that the character printed by the type head 38 can be seen by the user. To this end, the two arms 242 are formed integrally with a base portion 246 which extends beneath the carriage 6 and is pivotally connected at its rear end to the typewriter body 4, for rotation about a horizontal axis 247 parallel to the direction of movement of the carriage slide 100. Near its front end, the base part 246 of the ribbon vibrator 244 rests on the end of a short lever 250, which is pivotally mounted on a laterally extending mounting member 252 formed integrally with one arm 196 of the shift member 190. Extending downwards from the lever 250 is an arm 254, the free end of which bears against the face 258 of an arm 256 formed integrally with the escapement release lever 138. Thus movement of the escapement release lever 138 by the bail 42 on operation of a type bar 20 effects pivotal movement of the lever 250 and consequent lifting of the ribbon vibrator 244. The vibrator lever 250 is raised and lowered with the shift member 190 on operation of the appropriate shift key 214, 215 or 216, so that the ribbon vibrator 244 is moved a corresponding amount to ensure that it remains in the appropriate position relative to the platen 310. The face 258 of the arm 256 formed on the escapement release lever 138 is long enough to ensure that the arm 254 of the vibrator lever 250 engages the face 258 in all three positions of the shift member 190, so that the vibrator 244 operates correctly in all three positions. The face 258 of arm 256 is inclined slightly to the vertical to compensate for the fact that the axis 247 about which the ribbon vibrator 244 pivots is not coincident with the axis about which the carriage 6 pivots, and to ensure that the displacement of the vibrator 244 on operation of a type bar 20 is substantially the same in all three positions of the carriage 6.

The carriage 6 comprises a frame moulded in one piece from plastics and carrying the rotatably mounted platen 310.

The movable plastics components of the typewriter, such as the shift member 190 and back-space dog 160, may be formed of acetal co-polymer or acetal homopolymer.

I claim:

1. A typewriter having a body, a typebar assembly and a carriage which is movable vertically relative to the typebar assembly to enable the carriage to take up one of three positions to provide three cases of type, in which the carriage rests on a single shift member slidable vertically in guides formed in the typewriter body, and there is provided biasing means acting between the typewriter body and the shift member and biasing the shift member upwardly with a force sufficient to overcome the weight of the carriage acting on the shift member, stop means preventing upward movement of the shift member by the biasing means beyond an intermediate position, a first shift key linked to the shift member so that actuation of the first shift key lifts the shift member and carriage beyond the intermediate position to an uppermost position, and a second shift key linked to the shift member so that actuation of the second shift key moves the shift member and carriage downwards against the bias of the biasing means to a lowermost position, the lowermost, intermediate and uppermost positions of the carriage corresponding to the said three cases of type.

2. A typewriter as claimed in claim 1, in which the biasing means is a spring and the stop means comprises a stop formed on the shift member and engaged by the spring when the carriage and shift member are in the intermediate position.

3. A typewriter as claimed in claim 2, in which the shift member is formed with a vertically elongated recess into which fits an abutment member fixed to the typewriter body, the biasing means is a helical compression spring acting between a face of the abutment member and the uppermost end of the recess and the stop comprises at least one face on the shift member which, when the carriage and shift member are in the intermediate position, is aligned with the said face of the abutment member and is engaged by the spring.

4. A typewriter as claimed in claim 3, in which the shift member is formed in one piece from plastics.

5. A typewriter as claimed in claim 1, in which there is provided a ribbon vibrator arranged on operation of a type bar to raise a length of ribbon supported by the vibrator to the appropriate position between a platen and a type head on the type bar and to lower the length of ribbon after said ribbon has been struck by the type head, and in which the vibrator is moved through the intermediary of a lever pivotally mounted on the shift member, the lever engaging the vibrator so that the vibrator moves together with the shift member on movement of the shift member from one to another of its three positions, and the lever being engaged by an element movable on actuation of each type bar thereby to operate the vibrator, the engagement between the lever and element being between two mutually contacting members formed on the lever and element respectively, at least one of the said mutually contacting members being generally vertically elongated to ensure engagement between the element and lever to operate the vibrator in each of the three positions of the shift member.

6. A typewriter as claimed in claim 1, in which the guides formed in the body of the typewriter provide two pairs of opposed vertical faces between which parts of the shift member slide, and the ratios of the vertical length of mutually engaging faces on the shift member and the guides to the horizontal widths between the opposed faces of each pair of faces on the guides are sufficient to inhibit jamming of the shift member due to turning moments about a horizontal axis exerted on the shift member in operation.

* * * * *